United States Patent [19]

Fisher

[11] Patent Number: 4,644,892

[45] Date of Patent: Feb. 24, 1987

[54] BUOYANT TRAMPOLINE

[76] Inventor: Gavin R. Fisher, Unit 2, Bora Place, 1987 Gold Coast Highway, Miami, 4220, Queensland, Australia

[21] Appl. No.: 607,426

[22] Filed: May 7, 1984

[30] Foreign Application Priority Data

Jul. 27, 1983 [AU] Australia ..... 17321/83

[51] Int. Cl.[4] ..... A63B 5/10

[52] U.S. Cl. ..... 114/264; 272/65

[58] Field of Search ..... 114/61, 345, 264; 272/65, 66, 1 B; D21/235

[56] References Cited

U.S. PATENT DOCUMENTS 3,047,294 7/1962 Maxwell ..... 272/65
3,310,305 3/1967 Howe ..... 272/65
3,513,494 10/1968 Tailer ..... 114/345
4,159,551 7/1979 Iwai ..... 114/345
4,452,444 6/1984 Schulze ..... 272/65

FOREIGN PATENT DOCUMENTS 634998 2/1962 Italy ..... 272/66

*Primary Examiner*—Trygve M. Blix
*Assistant Examiner*—Thomas J. Brahan

[57] ABSTRACT

A water-borne buoyant device to enable users to enjoy leisure time activity in an aquatic environment includes a frame member defining a trampoline support frame, an elevated platform supported by the support frame, a resiliently mounted trampoline mat attached about its periphery to the support frame, and a buoyant member, such as one or more inflatable chamber(s), about the periphery of the support frame.

11 Claims, 13 Drawing Figures

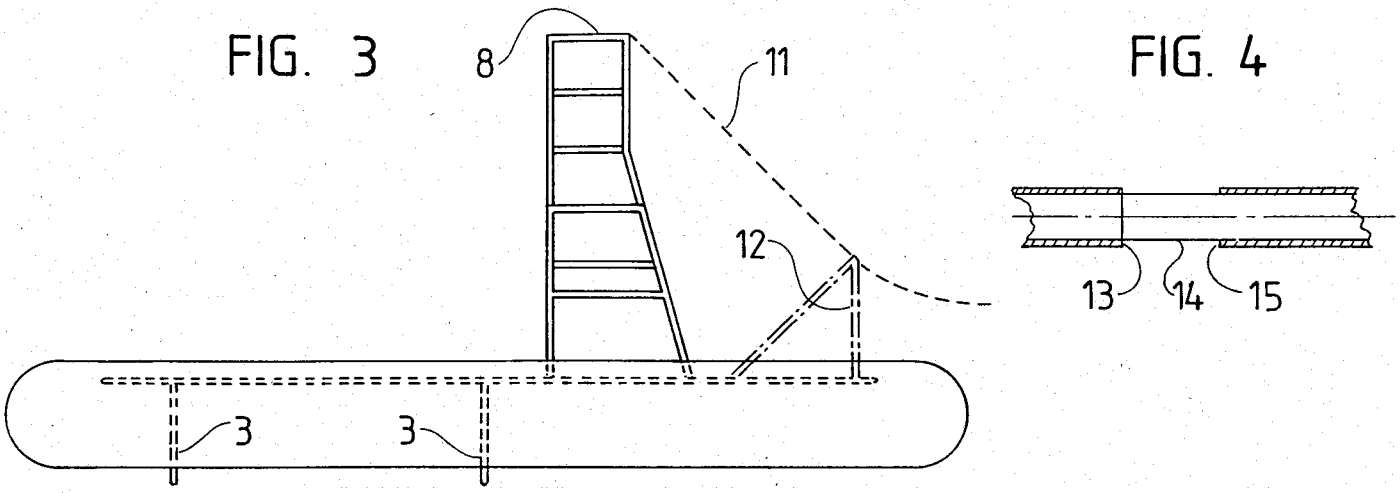
FIG. 3
FIG. 4
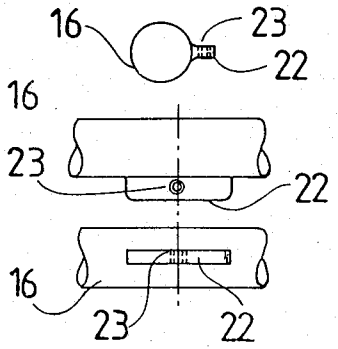
FIG. 6
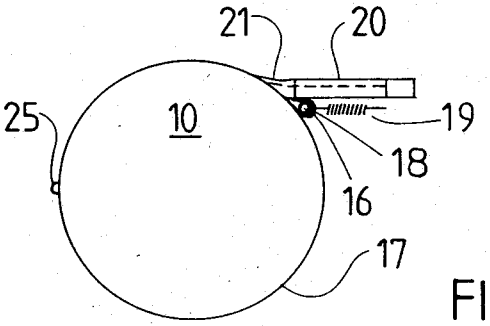
FIG. 5

BUOYANT TRAMPOLINE

This invention is concerned with a water-borne device to enable users to enjoy leisure time activity in an aquatic environment.

With the advent of the technological revolution there is a need for people to be able to utilize their increasing amounts of leisure time effectively. Most of today's amusement centres and recreational facilities however require a considerable capital investment on the part of entrepreneurs providing such facilities. High initial costs and high operating and maintenance costs thus have a tendency to make pursuit of recreation rather expensive from the consumer's point of view.

The present invention aims to provide a business opportunity which offers the advantages of low initial cost and low operating and maintenance costs with consequential benefits to the patrons of such a recreational facility.

According to one aspect of the invention there is provided a buoyant marine structure comprising:

a frame member defining at least one trampoline support frame;

an elevated platform supported by said support frame intermediate the ends of said support frame;

a resiliently mounted trampoline mat attached to said support frame adjacent one end thereof;

a rigid platform member supported by said support frame adjacent an end opposite to said one end; and, buoyancy means located about the periphery of said support frame, said buoyancy means comprising a plurality of inflatable bladder-like members located within a flexible reinforcing cover member having means enabling selective access to said bladder-like members.

Preferably said frame member comprises tubular metal members adapted to be disassembled.

According to another aspect of the invention there is provided a method of manufacturing a buoyant marine structure comprising:

assembling a plurality of frame elements to define a frame member having one or more trampoline support frames and an elevated platform associated with each said support frame;

resiliently mounting trampoline mats in juxtaposition with corresponding apertures in said support frames;

removably attaching a hollow flexible outer cover member to an outer periphery of said frame member; and, inserting a plurality of inflatable bladder-like members into said outer cover member whereby upon inflation, said inflatable bladder-like members occupy substantially the entire interior of said hollow cover member.

Preferred embodiments of the invention will now be described with reference to the accompanying drawings in which:

FIG. 3 is a side elevation.

FIG. 4 shows an enlarged view of a joint between frame elements.

FIG. 5 is an enlarged partial cross section of an outer buoyancy member and frame attachment.

FIG. 6 shows a trampoline spring attachment.

The apparatus illustrated comprises a dual floating trampoline although it will be readily apparent to a skilled addressee that with suitable modification the apparatus could comprise a floating work platform with integral scaffold, a floating outdoor restaurant, dance floor etc.

Figure 1:
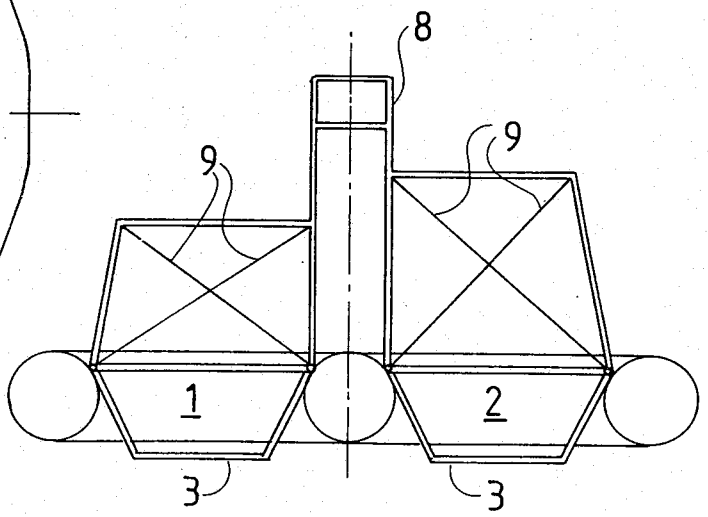
FIG. 1 is a plan view of one embodiment of the invention.
Figure 2:
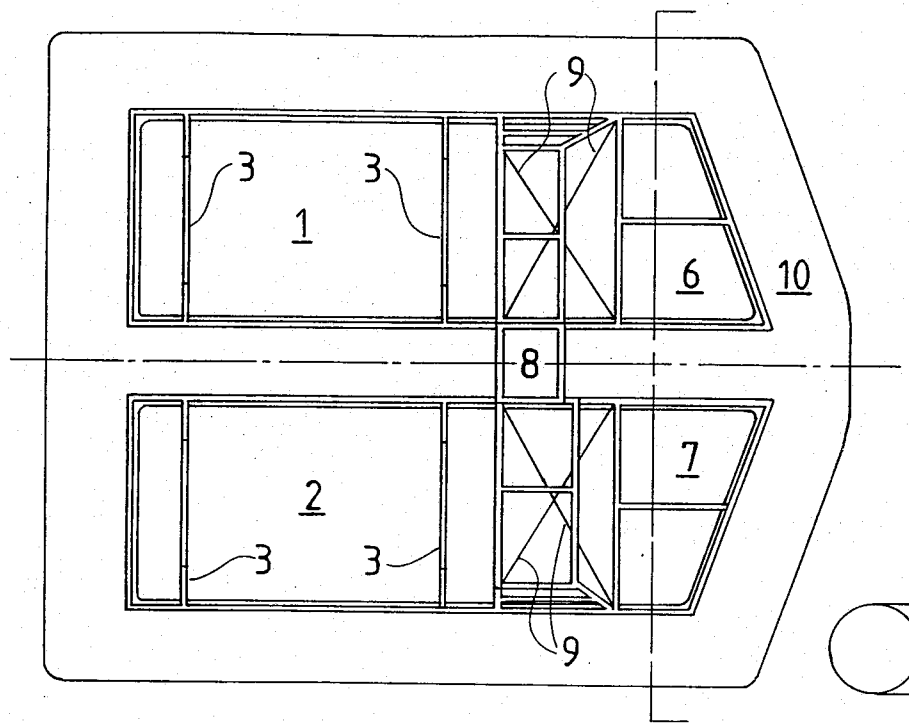
FIG. 2 is a cross sectional elevation through X—X in FIG. 1.

In FIGS. 1 and 2 the apparatus comprises a pair of adjacent trampoline areas 1 and 2 having transverse downwardly depending reinforcing frames 3. At the end of each trampoline area are elevated platforms 4 and 5 each of different height and accessible by scaling ladders (not shown) from platforms 6 and 7. From the elevated platforms a user is able to jump onto either one of the trampoline areas 1 or 2.

A central tower 8 defines a further elevated platform. Reinforcing of the elevated platform frames is achieved by cables or the like 9 extending between diagonally opposed corners of the platform frames.

An inflatable buoyancy member 10 extends around the periphery of the structure framework as well as between the trampoline frames. The byoyancy member comprises an outer cover of durable flexible material such as PVC coated nylon fabric. This fabric is extremely durable and is resistant to weathering, tearing and rotting. Within the outer cover are located a number of inflatable bladders of plastics or rubber material. Each bladder is accessible via a laced opening in the outer cover for the purposes of repair or replacement. It has been found particularly advantageous to utilize a number of bladders say 5–10 as in the event of puncture, the bladder may be repaired or replaced with the structure floating at its moorings. In this manner, usable time is not interfered with and the buoyant structure does not become unstable and thus unsafe. The buoyancy means 10 is attached to the tubular frame members of the structure by flexible loops attached to the outer cover of buoyancy means 10.

FIG. 3 is a side view of the apparatus of FIGS. 1 and 2. If required, a slide 11 (shown in phantom) could be attached between the central platform 8 and a support bracket 12 (shown in phantom) mounted on the platforms 6 and 7.

FIG. 4 shows the releasable interconnection of tubular frame elements. The joint comprises a spigot and socket wherein one end of a tubular member 13 comprises the socket and a rod-like member 14 inserted into the end 15 of an adjoining element comprises the spigot. Rod-like member 14 may be glued, rivetted or welded into tube end 15 as a permanent fixture or it may be simply held by a screw, bolt, split pin or the like. The demountable joint between spigot 14 and socket 13 may be achieved by a grub screw, split pin or the like.

FIG. 5 shows the method of attachment of the frame to the buoyancy means 10. A loop 16 of PVC coated nylon fabric is stitched, glued or welded to the outer cover 17 of buoyancy member 10. Portion of a tubular frame element 18 can be shown located within the loop aperture. Spring 19 is attached at one end to frame element 18 and at its other end to the trampoline mat (not shown). To avoid injury to users who might otherwise come into contact with the frame member surrounding the trampoline mat or the trampoline springs, a cushioned flap 20 is hingedly attached to buoyancy member 10 by say a VELCRO (Trademark) fastening tape 21. The cushioned flap 20 is wide enough to cover both the trampoline frame support and the trampoline springs. The mat 20 extends along all four sides of the trampoline frame.

FIG. 6 shows the method of attaching the trampoline springs to the frame element 16. A lug 22 is simply welded at suitably spaced intervals on the frame elements and a nylon bush 23 is inserted into the lug to accept the spring hook.

For the safety of swimmers, a safety rope 24 is laced through eyes 25 welded to the outer cover 17 of buoyancy means 10.

Figure 8:
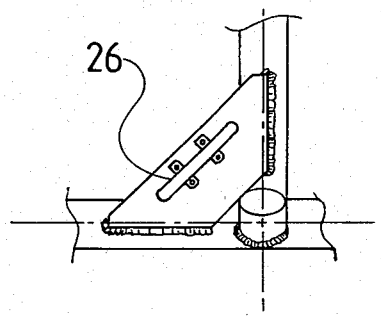
FIG. 8 shows a mooring cleat attachment.
Figure 7:
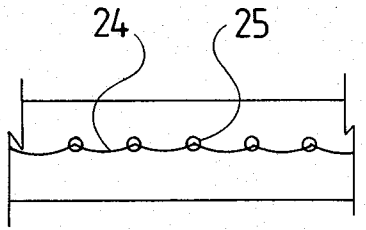
FIG. 7 shows the manner of attachment of a safety rope.

FIG. 8 shows the method of attachment of a mooring cleat 26 to the frame.

Figure 9:
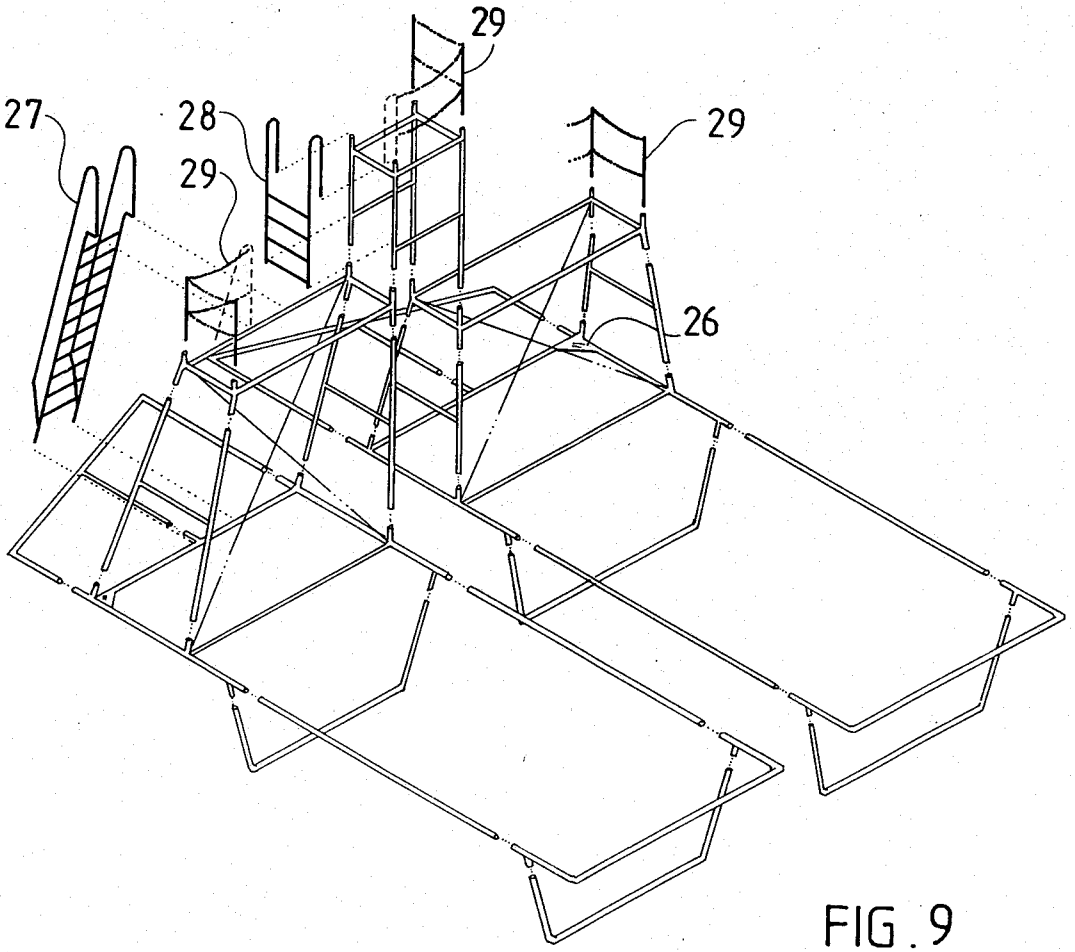
FIG. 9 is an exploded frame assembly.

FIG. 9 is an exploded frame assembly showing the positioning of certain of the ladders 27 and 28 and safety rails 29.

From the foregoing description, it can be seen that the floating structure is relatively inexpensive and simple to construct, not requiring any skilled labour. The modular construction enables the structure to be readily shipped to a site for use or disassembled for movement to another site.

The combined safety features enable the device to be utilized by a large number of people at a time with little or no risk of injury to users. If required the elevated platform structure may be covered with a fabricated PVC coated nylon fabric cover. The interior of the elevated platform structures may then be used to house equipment such as inflation pumps, repair equipment etc. and/or may be used as a shelter or ticket office by an attendant. The large external surfaces of the covered platform structures may bear decorative or publicity indicia.

The surfaces of platforms 6 and 7 as well as those of the elevated platforms may be covered by any suitable material such as marine grade plywood. Provision of platforms 6 and 7 has the particular advantage that users waiting to scale the ladders to the elevated platforms can wait safely on the platform without having to remain in the water.

Mooring cleats 26 are suitably on either side of the apparatus as shown in FIG. 9 such that after assembly on the shore, the buoyancy means is inflated and the apparatus is towed to a suitably safe depth of water, say 4 meters. One or more ground anchors may be used to moor the apparatus at a suitable site.

The apparatus illustrated in FIGS. 1–3 and 9 comprises a rigid frame structure by means of the interconnection of the elevated frames associated with each of the adjacent trampoline mats. The frame structure is sufficiently rigid for use in sheltered mooring sites but it is considered that additional reinforcing would be required for use in less sheltered areas where wave action may impose prolonged cyclic stresses on the frame.

An alternative embodiment of the invention is illustrated in FIGS. 10–13.

The apparatus comprises a pair of substantially identical floating trampoline structures 30, 31 having mirror image plan views. The two floating structures are attached by suitable flexible attachment means such as rope lashings 32 between the respective frames. The use of separate structures to provide the arrangement shown generally in FIG. 2 has a number of advantages. The flexible or non-rigid interconnection permits a degree of flexure in the structure due to wave action which might otherwise impose severe stresses on an unreinforced frame. This absence of reinforcing in the frame gives rise to substantial cost savings in the frame structure. In addition, it has the advantage that a purchaser may reduce his initial capital outlay in purchasing a single floating structure and then as liquidity permits or demand for usage grows, a further unit can be purchased and simply attached as shown. Yet another advantage arises in the ease of transportation and handling of the relatively small frame members, buoyancy covers and the like. In the event that one of the inflatable buoyancy chambers in the central region between the trampolines requires repair or maintenance, the paired structures are simply unlashed to enable access from a side. This avoids the necessity for obtaining access from the top of bottom as would otherwise be required with the arrangement of FIG. 2.

In the embodiment shown the elevated frame structures 33, 34 may be of the same height or of different heights. The rigid platform area extends from under each tower from adjacent the edge of the trampoline through to the inclined edge 35 of the support frame 36. If required, the support platform could extend from the opposed outer edges 37, 38 of the respective support frames 36 either as a single rigid member or as a plurality of members able to flex with flexure of the entire assembly. The elevated frame structures 33, 34 are open at their rearward faces to enable access thereunder.

Figure 10:
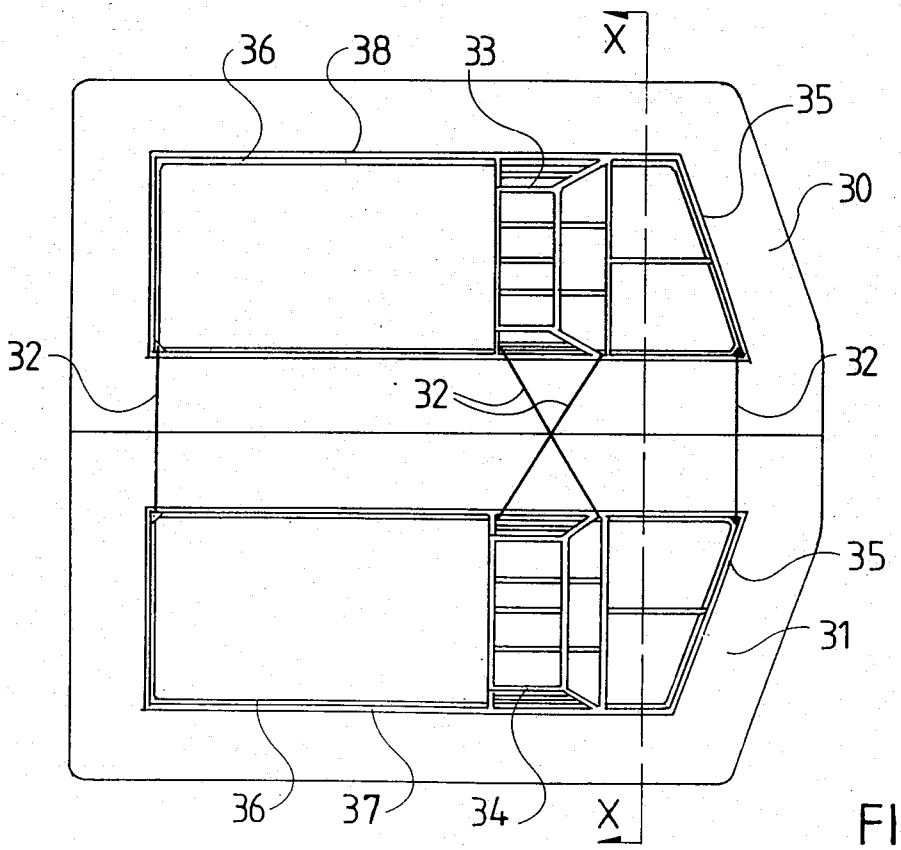
FIG. 10 shows a plan view of an alternative embodiment.
Figure 11:
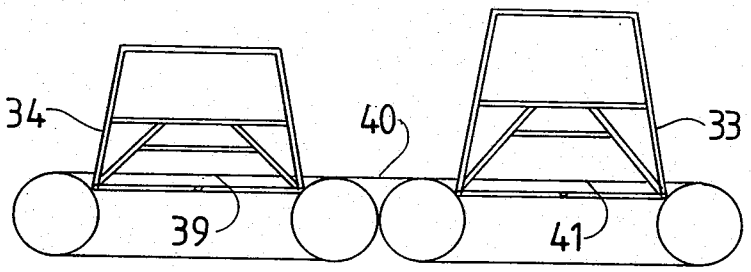
FIG. 11 is a cross sectional elevation through X—X in FIG. 10.

FIG. 11 shows a cross section through FIG. 10 in the direction X—X. A platform area is comprised of three rigid members 39, 40 and 41 which enable a stress free flexure of the assembly under wave action.

Figure 12:
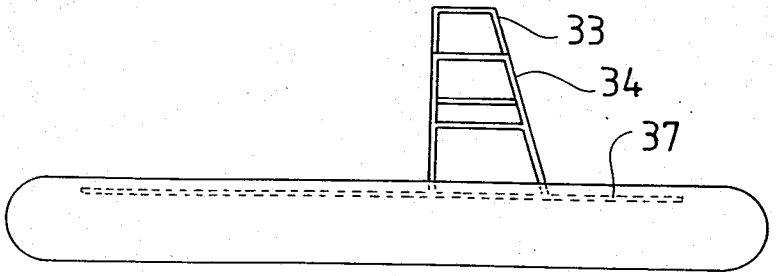
FIG. 12 is a side elevation of the assembly of FIG. 10.

FIG. 12 shows a side elevation of the arrangment of FIG. 10.

Figure 13:
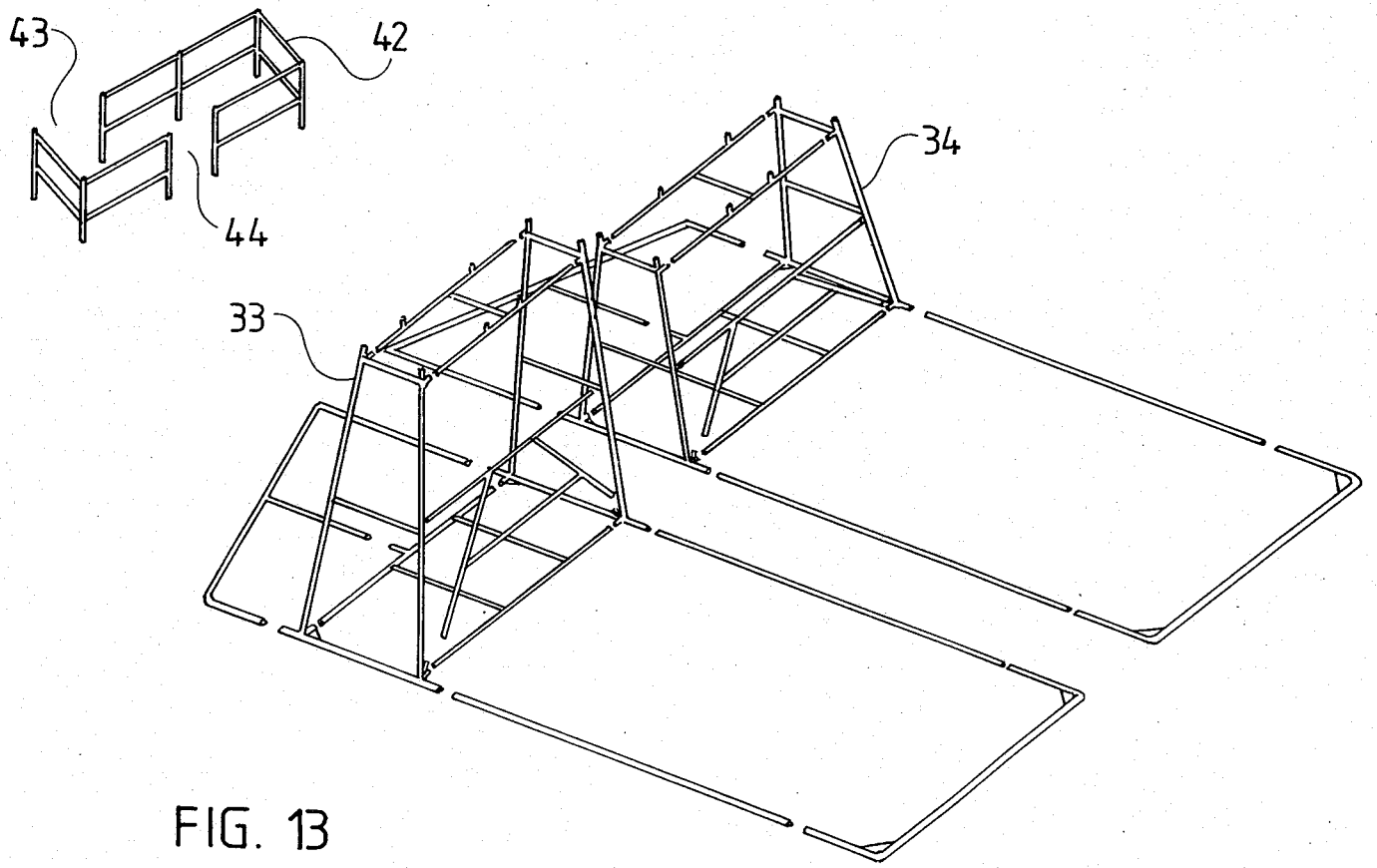
FIG. 13 is a view of the modular frame assemblies.

FIG. 13 shows the modular frame assemblies of the arrangement of FIG. 10. In a most preferred form, each elevated frame assembly 33, 34 includes a safety fence 42 having an access gateway 43 accessible by a ladder (not shown) supported on the frame assembly. An exit gateway 44 is provided to ensure that users jump singly onto the trampoline thus alleviating the possibility of accidents.

It will be readily apparent to a skilled addressee that many variations or modifications may be made to the invention without departing from the spirit and scope thereof.

I claim:

1. A buoyant marine structure comprising:

a frame member defining at least one trampoline support frame;

an elevated platform supported by said support frame;

a resiliently mounted trampoline mat attached about its periphery to said support frame;

said elevated platform providing an enlarged area for jumping off onto said trampoline mat, said resiliently mounted trampoline mat being located about a major portion of said support frame; and buoyancy means formed of at least one inflatable bladder like member located about the periphery of said support frame and said trampoline mat, said trampoline mat being located within the interior periphery of said buoyancy means.

2. A structure as claimed in claim 1 wherein said buoyancy means comprises at least one inflatable chamber located within a flexible reinforcing cover member.

3. A structure as claimed in any of claim 1 or 2 wherein said buoyancy means includes a plurality of inflatable chambers.

4. A structure as claimed in claim 3 wherein said flexible reinforcing cover member includes access means to permit removal or replacement of selected inflatable chambers.

5. A structure as claimed in any of claim 1 or 2 wherein said elevated platform is located intermediate the ends of said support frame.

6. A structure as claimed in claim 5 including a support platform adjacent one end of said frame member.

7. A structure as claimed in claim 6 wherein said support platform comprises a substantially rigid surface.

8. A structure as claimed in any of claim 1 or 3 comprising a pair of trampoline support frames separated longitudinally by at least one buoyancy means.

9. A structure as claimed in claim 8 including an elevated platform associated with each said trampoline mat, each respective elevated platform means being interconnected.

10. A structure as claimed in claim 1 wherein said buoyancy means extends in a plane parallel to the plane of said trampoline mat, the plane defined by the upper edge of said buoyancy means being higher in elevation than the plane of said trampoline mat.

11. A buoyant marine structure as claimed in claim 10 wherein a cushioned flap is secured to said buoyancy means for covering said support frame.

* * * * *